United States Patent [19]

Romano

[11] 4,200,780

[45] Apr. 29, 1980

[54] CONTROL ASSEMBLY WITH ROTATING DISC COVER FOR SLIDING CONTROL

[75] Inventor: John V. Romano, San Jose, Calif.

[73] Assignee: Atari, Inc., Synnyvale, Calif.

[21] Appl. No.: 870,276

[22] Filed: Jan. 18, 1978

[51] Int. Cl.[2] ..... H01C 10/44; H01C 9/04

[52] U.S. Cl. ..... 200/302; 116/321; 116/281; 338/161; 338/176; 273/86 B; 273/DIG. 28; 273/1 E

[58] Field of Search ..... 200/302, 308; 338/161, 338/176, 162, 163, 164, 165; 339/41; 116/129 AB, 124.2 A; 273/85 G, 86 R, 1 E

[56] References Cited

U.S. PATENT DOCUMENTS

| | | | |
|---|---|---|---|
| 340,868 | 4/1886 | Fairchild | 200/308 |
| 2,220,951 | 11/1940 | Borden | 338/165 |
| 2,252,829 | 8/1941 | Bell | 200/302 |
| 2,886,675 | 5/1959 | Berry | 200/302 |
| 3,639,877 | 2/1972 | Fresard et al. | 338/165 |
| 3,723,692 | 3/1973 | Wilbrecht | 200/302 |
| 3,853,376 | 12/1974 | Marechal | 339/41 |

FOREIGN PATENT DOCUMENTS

| | | | |
|---|---|---|---|
| 568583 | 4/1945 | United Kingdom | 338/162 |

*Primary Examiner*—Richard C. Pinkham
*Assistant Examiner*—Lawrence E. Anderson
*Attorney, Agent, or Firm*—Townsend & Townsend

[57] ABSTRACT

An electronic amusement game incorporating manually operated control circuit devices. A control panel in the game housing is formed with slots through which operating handles of the devices project. A circular protective cover is rotatably mounted between the device and inside surface of the panel. The operating handle projects through a radial slot formed in the cover so that linear movement of the handle rotates the cover. In all positions of the handle the cover provides a shield beneath the panel slot.

7 Claims, 4 Drawing Figures

CONTROL ASSEMBLY WITH ROTATING DISC COVER FOR SLIDING CONTROL

BACKGROUND OF THE INVENTION

This invention relates in general to electronic amusement games of the type incorporating manually operated control circuit devices, such as linear potentiometers.

In certain types of electronic amusement games the control circuit devices, such as linear potentiometers, are manually operated by the players to control the game. Such amusement games typically include a housing having a control panel formed with slots along which the operating handles or knobs of the devices are moved.

In amusement games of the type described it is desirable to provide some means for covering the exposed panel slot for aesthetic reasons as well as to prevent ingress of dust, dirt, small solid objects and other objectionable foreign matter which could damage or render inoperable components of the game behind the panel. A solution which has heretofore been suggested to this problem is that of fixedly attaching a dust cover to the handle below the panel slot. However, in such a design the cover must be approximately twice the length of the slot to ensure that the slot remains covered throughout the full range of travel of the handle. In many cases this arrangement is not satisfactory. For example, such a dust cover arrangement cannot be employed with a control panel of small dimensions, or alternatively an oversize panel and housing would be required which would increase manufacturing costs and result in poor space utilization.

OBJECTS AND SUMMARY OF THE INVENTION

It is a general object of the invention to provide a new and improved control panel assembly for an electronic amusement game of the type employing manually operated control circuit devices.

Another object is to provide a control panel assembly of the character described incorporating a protective cover for panel slots for linearly movable operating handles of control circuit devices.

Another object is to provide a control panel assembly of the character described employing a protective cover for a panel slot which permits the cover to be mounted in a panel of relatively compact size.

Another object is to provide an electronic amusement game having control panel slots which are covered throughout the full range of travel of linearly movable operating handles of control circuit devices.

The invention in summary includes an electronic amusement game having control panels formed with slots through which operating elements of control circuit devices project. A disc is rotatably mounted between the device and panel with the operating element projecting through a radial slot formed in the disc. Linear movement of the operating element along the panel slot causes the disc to rotate and maintain coverage of the panel slot throughout the full range of travel of the element.

The foregoing and additional objects and features of the invention will appear from the following specification in which the several embodiments have been set forth in detail in conjunction with the accompanying drawings.

DESCRIPTION OF THE PREFERRED EMBODIMENTS

Figure 1:
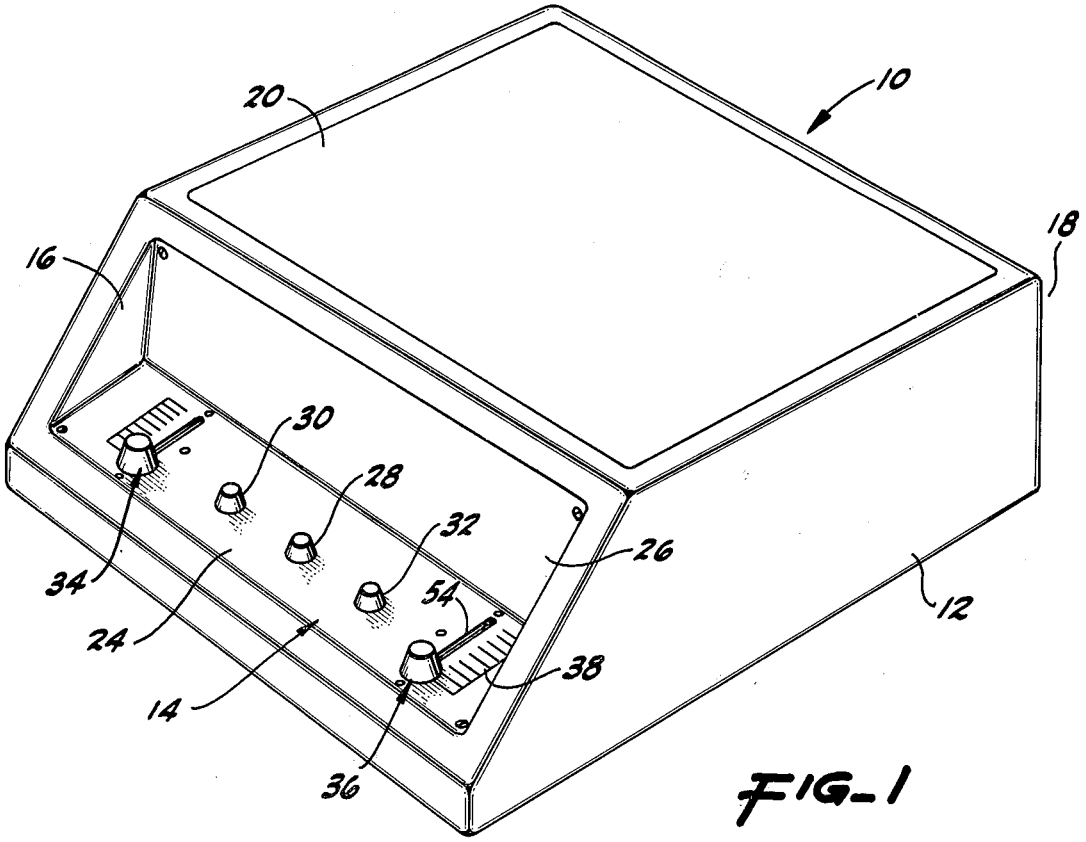
FIG. 1 is a perspective view of an electronic amusement game incorporating the invention.

In the drawings FIG. 1 illustrates generally at 10 an electronic amusement game which incorporates the invention. Game 10 includes a housing 12 which mounts a control panel assembly 14 in a front recess 16. Another control panel assembly, similar in construction to assembly 14, is provided on the opposite side 18 of the housing. A transparent top panel 20 carried by the housing covers a suitable upwardly facing video tube, not shown, which is operated by a control circuit in a known manner to generate a video display in accordance with the game program. For example, the control circuit could be programmed to generate a video display simulating race cars moving along a track. The illustrated embodiment of the amusement game is specially adapted for installation on a frame or pedestal in a booth. In such case players seated on opposite sides of the game can operate the controls and view the video display while using the top of panel 20 for purposes such as serving drinks or food.

Control panel assembly 14 includes a flat metal sheet shaped to form a generally horizontally control panel 24 and an upwardly and rearwardly inclined top panel 26. Operating elements of the control circuit are mounted on panel 24 and include, for example, a game reset button 28, a start button 30 for the car operated by one player, a start button 32 for the car operated by another player, and a pair of linearly movable speed controls 34, 36 for controlling the speed of the respective cars. The control panel assembly on the opposite side of the housing would contain a similar set of buttons and speed controls for operation by players sitting on the opposite side of the game. Suitable scale indicia 38 is formed along each speed control for use by the players in moving the controls to the desired speed setting.

Figure 2:
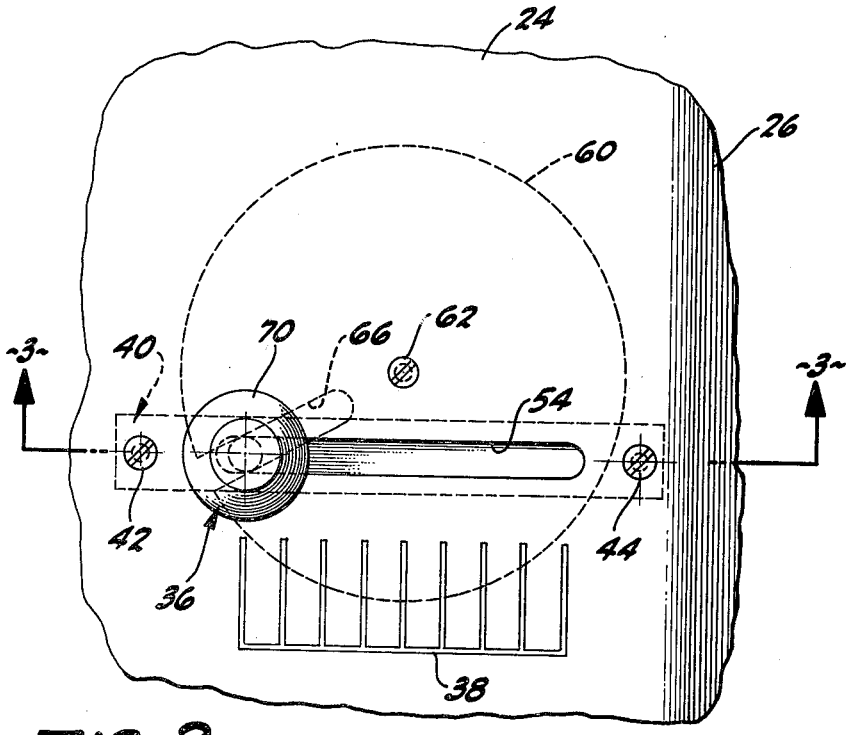
FIG. 2 is a fragmentary top plan view of the control panel of the game of FIG. 1.
Figure 3:
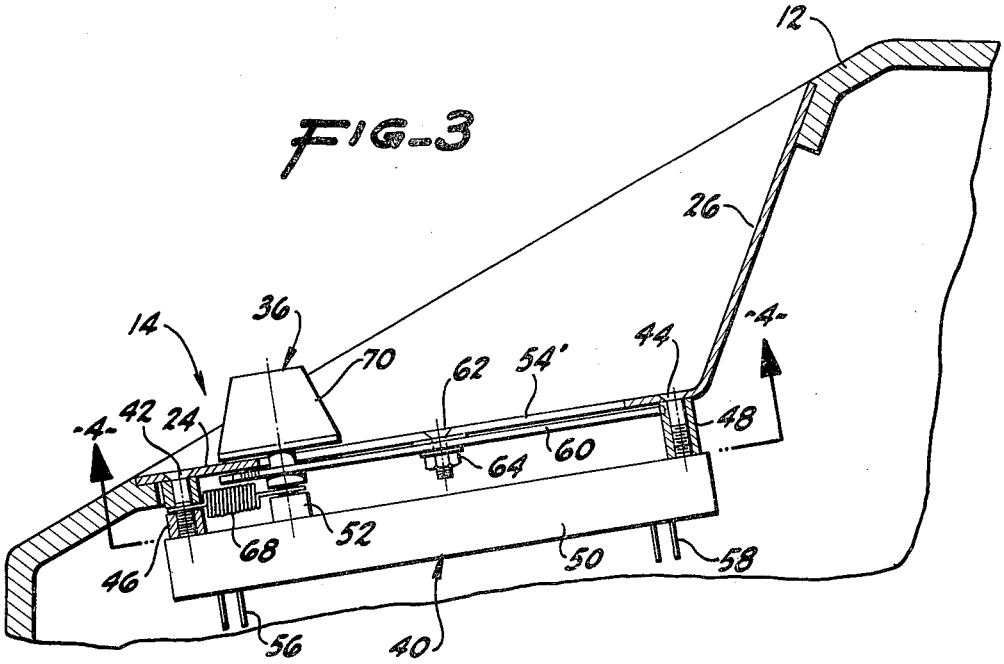
FIG. 3 is a cross-sectional view taken along the line 3—3 of FIG. 2.
Figure 4:
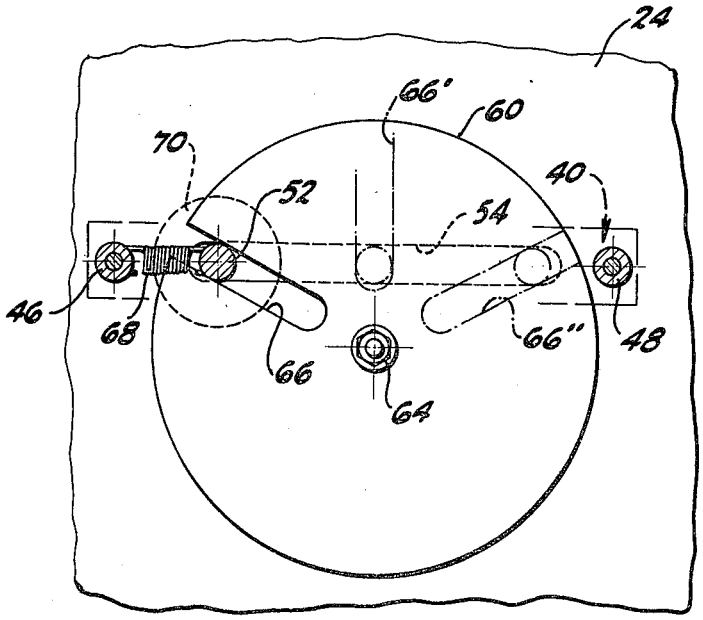
FIG. 4 is a fragmentary bottom plan view taken along the line 4—4 of FIG. 3.

Details of the typical speed control 36 are illustrated in FIG. 2-4, and it is understood that the construction and operation of the remaining speed controls is similar. Speed control 36 includes a control circuit device comprising a linear potentiometer 40 mounted at its opposite ends by a pair of bolts 42, 44 and spacers 46, 48 below the lower surface of control panel 24. The potentiometer is conventional and includes an elongate housing 50 within which a potentiometer slide, not shown, is moved linearly by means of an upwardly projecting operating element or handle 52. The handle also projects through an elongate control panel slot 54 which extends over the path of movement of the handle. Terminals 56, 58 are provided on the potentiometer for connection through suitable leads, not shown, with the game control circuit.

The opening made by panel slot 54 is covered or shielded by a protective cover or disc 60. The disc preferably is of circular shape with an outer circumference sufficient to encompass the slot length while at the same time having a relatively small overall dimension permitting the assembly to be mounted in a housing of compact size, e.g. for the described booth installation. The disc is positioned immediately below control panel 24 and is mounted for rotation about an axis perpendicular to the panel by means of a bolt 62, the lower end of which carries a lock washer and nut 64.

Means is provided for coupling disc 60 with the potentiometer operating handle 52 to permit both linear movement of the handle and rotation of the disc. The coupling means includes a slot 66 formed radially through the disc with the operating handle projecting through the disc slot. The axis of rotation of the disc is spaced from the long axis of the panel slot so that linear movement of the operating handle applies a force moment through the slot to rotate the disc. Means comprising a return spring 68 is provided for yieldably biasing the operating handle toward the lower end of the potentiometer, as shown in solid line in FIGS. 3 and 4. One end of the spring is hooked around mounting bolt 42 and the other end is hooked around the operating handle of the potentiometer.

A frusto-conical control knob 70 is mounted to freely rotate on the distal end of operating handle 52 above panel 24. The lower margin of the knob is sized with a circumference sufficient to encompass the maximum uncovered or exposed portion of the panel slot which is in register with the disc slot at the opposite extreme positions of the operating handle. The knob in combination with the disc thereby provide complete shielding for the slot opening in the panel.

The use and operation of the invention is as follows. During operation of amusement game 10 the player grasps control knob 70 to move potentiometer operating handle 52 to the desired speed setting along slot 54. The operating handle moves the potentiometer slide to vary the electrical signal transmitted to the control circuit. Movement of the handle applies a moment to rotate disc 60, with the handle also undergoing relative movement along disc slot 66. In FIG. 4 the mid-position of handle and disc slot is illustrated at 66' and the extreme position of the handle and disc slot is illustrated at 66". The handle and disc are returned to their initial positions by the action of spring 68. Throughout the full range of movement of the operating handle the disc in combination with the control knob maintain complete shielding for the panel slot to prevent ingress of foreign matter and for an attractive panel appearance.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A control panel assembly for an amusement game having a control element which is movable linearly by a user's providing linear motion to operate an electrical circuit, the assembly comprising the combination of a panel having an elongate slot through which the control element projects and along which the control element is movable linearly, said control element being part of an electrical device mounted on the inside of said panel, a disc positioned in close-spaced parallel relationship with a side of the panel at a location where the disc substantially covers the panel slot, means for mounting the disc for rotation about an axis perpendicular to the panel, and means for coupling the disc with the control element while leaving the control element extending beyond the panel and the disc to permit the control element to move along the slot while the disc rotates and continues to substantially cover the portion of the slot not occupied by the control element, said coupling means including means forming a radially extending slot in said disc, said control element projecting through the disc slot for relative sliding movement therealong as the element undergoes linear movement along the panel slot for operating the electrical circuit, said disc being positioned between the electrical device and the panel whereby the disc covers the panel slot on the inside of the panel.

2. A control panel assembly as in claim 1 which includes a control knob mounted on the distal end of the control element, said control knob having an outer periphery which substantially encompasses any portion of the panel slot which is in register with the disc slot whereby the knob covers such portion of the panel slot.

3. A control panel assembly as in claim 1 in which the electrical device comprises a linear potentiometer and the control element comprises a handle which operates the potentiometer.

4. A control panel assembly as in claim 1 in which the panel slot has a longitudinal centerline spaced from the axis of rotation of the disc whereby the control element during movement along the panel slot acts against the disc slot to apply a rotational moment to the disc.

5. A control panel assembly as in claim 4 which includes means for yieldably biasing the control element toward one end of the panel slot.

6. An amusement game of the character having an electrical control circuit for operating the game, including the combination of a housing having a control panel, means forming at least one slot in the panel, at least one control circuit device mounted behind the panel, said device having an operating handle which projects through and is linearly movable along the slot, said slot being in registry with the path of movement of said handle, a circular disk-shaped protective cover positioned between the panel and device, said cover having an outer periphery which substantially encompasses the panel slot from behind, means forming an elongate radially extending slot in the cover, said operating handle of the control circuit device projecting through the cover slot whereby movement of the handle along the panel slot causes the handle to rotate the cover and further causes relative movement of the handle along the cover slot such that those portions of the panel slot not occupied by the operating handle are substantially covered by a portion of the cover.

7. An amusement game as in claim 6 in which the the control circuit device comprises a linear potentiometer.

* * * * *